US008023856B2

(12) United States Patent
Okazaki

(10) Patent No.: US 8,023,856 B2
(45) Date of Patent: Sep. 20, 2011

(54) IMAGE-FORMING DEVICE WITH A CLEANING MECHANISM

(75) Inventor: Yoshiyuki Okazaki, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 430 days.

(21) Appl. No.: 12/256,218

(22) Filed: Oct. 22, 2008

(65) Prior Publication Data

US 2009/0116870 A1 May 7, 2009

(30) Foreign Application Priority Data

Oct. 25, 2007 (JP) ..... 2007-277857

(51) Int. Cl.
*G03G 15/16* (2006.01)
*G03G 21/00* (2006.01)

(52) U.S. Cl. ..... 399/101

(58) Field of Classification Search ..... 399/101, 399/343, 123

See application file for complete search history.

(56) References Cited

U.S. PATENT DOCUMENTS

| | | | | |
|---|---|---|---|---|
| 5,170,184 | A | 12/1992 | Hanabusa et al. | 346/134 |
| 5,497,872 | A * | 3/1996 | Pennino | 198/498 |
| 6,049,684 | A * | 4/2000 | Nishikawa et al. | 399/249 |
| 2006/0093395 | A1 * | 5/2006 | Igarashi et al. | 399/101 |
| 2006/0222401 | A1 * | 10/2006 | Kamimura | 399/101 |
| 2007/0025762 | A1 * | 2/2007 | Kato et al. | 399/121 |
| 2007/0147903 | A1 | 6/2007 | Mori | 399/264 |

FOREIGN PATENT DOCUMENTS

| | | |
|---|---|---|
| JP | 3-203673 | 9/1991 |
| JP | 5-16473 | 1/1993 |
| JP | 5-134560 | 5/1993 |
| JP | 6-24600 | 2/1994 |
| JP | 10-326068 A * | 12/1998 |
| JP | 2007-199675 | 8/2007 |

* cited by examiner

*Primary Examiner* — Sophia S Chen
(74) *Attorney, Agent, or Firm* — Scully, Scott, Murphy & Presser, PC

(57) ABSTRACT

A belt is disposed in a main body and moves circularly to transport a recording medium placed thereon. A cleaning roller contacts an outer surface of the belt for removing extraneous matter deposited on the outer surface of the belt. A pair of backup rollers is disposed in opposition to the cleaning roller with the belt interposed between the backup rollers and the cleaning roller. The pair of backup rollers contacting the belt at first and second positions and the cleaning roller contacting the belt at a third position where the third position is interposed between the first and second positions. A holder rotatably holds the pair of backup rollers. Rotational axes of the backup rollers are kept parallel to each other. An urging unit urges the backup rollers toward the cleaning roller. A driving unit is supported on the main body and moves the holder to change a distance between the pair of backup rollers and the cleaning roller.

19 Claims, 15 Drawing Sheets

IMAGE-FORMING DEVICE WITH A CLEANING MECHANISM

CROSS REFERENCE TO RELATED APPLICATION

The present application claims priority from Japanese patent application No. 2007-277857 filed Oct. 25, 2007. The entire contents of the priority application are incorporated herein by reference.

TECHNICAL FIELD

The present invention relates to an image-forming device.

BACKGROUND

The laser printer and other image-forming devices described in Japanese Patent Application Publication No-2007-199675 are well known in the art. This type of image-forming device includes a casing accommodating an endless belt for conveying paper or another recording medium, and an image-forming unit for forming images on the recording medium.

In such a device, paper dust generated from the paper, toner generated from the image-forming unit, and other extraneous matter is often deposited on the outer surface of the belt. One technique for removing this extraneous matter from the belt is as follows. First, a single cleaning roller is disposed in contact with the outer surface of the belt and is urged against the belt with pressure. In addition, a single backup roller is disposed on the inside surface of the belt at a position opposing the cleaning roller through the belt. By urging the backup roller toward the cleaning roller, the force with which the cleaning roller contacts the belt can be increased.

With this construction, the extraneous matter is transferred onto the cleaning roller by driving the cleaning roller to rotate. The matter transferred to the cleaning roller is subsequently transferred to a metal roller in contact with the cleaning roller and then scraped off the metal roller by a blade that contacts the metal roller with pressure.

SUMMARY

With the above construction, the lifespan of the backup roller is often different from the lifespan of the cleaning roller. Therefore, it is conceivable to configure the backup roller and cleaning roller to be relatively displaceable in order to replace either the backup roller or the cleaning roller when the two are separated.

However, after replacing one of the rollers in the above construction, there is a danger that the backup roller and cleaning roller will have shifted relative to each other when the rollers are once again in a state pinching the belt.

For example, if the relative positions of the backup roller and cleaning roller shift so that the rotational axes are no longer parallel, the belt is pinched between the two rollers only in a region contacted by both the backup roller and cleaning roller (a region intersecting the backup roller and cleaning roller). Consequently, the pressure from the cleaning roller is insufficient in regions of the belt that are not pinched between both rollers, potentially reducing the effect of the cleaning roller for removing extraneous matter from the belt.

In view of the foregoing, it is an object of the present invention to provide an image-forming device for improving the effects of the cleaning roller in removing extraneous matter from the belt.

To achieve the above and other objects, one aspect of the invention provides an image-forming device including a main body, a belt, a cleaning roller, a pair of backup rollers, a holder, an urging unit, and a driving unit. The main body includes an image-forming unit for forming images on a recording medium. The belt is disposed in the main body and moves circularly to transport the recording medium placed thereon. The belt has an outer surface. The cleaning roller contacts the outer surface of the belt for removing extraneous matter deposited on the outer surface of the belt. The pair of backup rollers is disposed in opposition to the cleaning roller with the belt interposed between the backup rollers and the cleaning roller. Each of the backup rollers having a rotational axis. The pair of backup rollers contacting the belt at first and second positions and the cleaning roller contacting the belt at a third position where the third position is interposed between the first and second positions. The holder rotatably holds the pair of backup rollers. Rotational axes of the backup rollers are kept parallel to each other. The urging unit urges the backup rollers toward the cleaning roller. The driving unit is supported on the main body and moves the holder to change a distance between the pair of backup rollers and the cleaning roller.

DETAILED DESCRIPTION

First Embodiment

Figure 1:
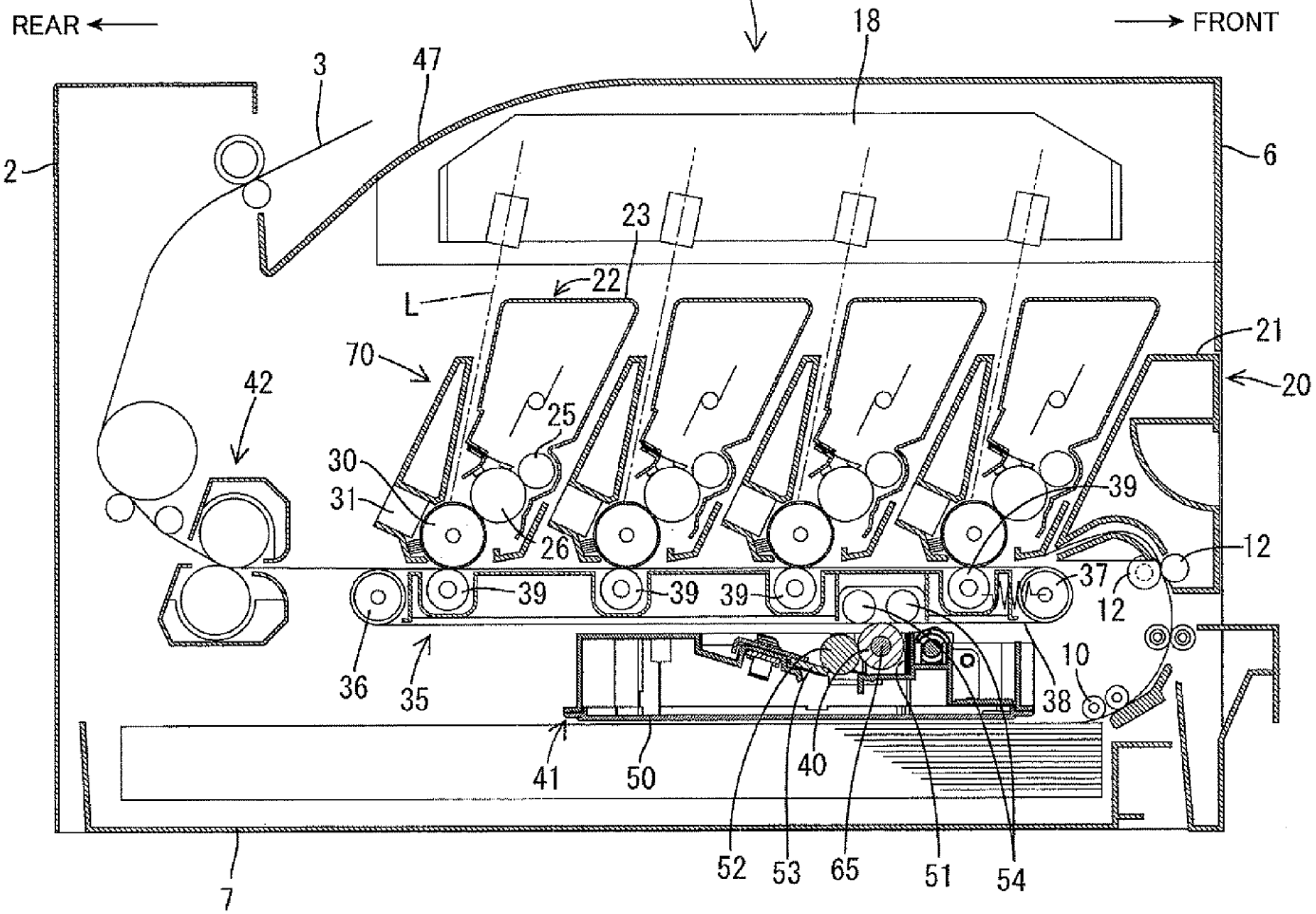
FIG. 1 is a side cross-sectional view showing the overall structure of a printer according to a first embodiment of the present invention.

Next, a first embodiment of the present invention applied to a printer 1 will be described while referring to FIGS. 1 through 7A. FIG. 1 is a side cross-sectional view showing the overall structure of the printer 1. In the following description, the right side of the printer 1 in FIG. 1 will be referred to as the "front" and the left side of the printer in FIG. 1 will be referred to as the "rear."

The printer 1 includes a casing 2, and a paper tray 7 disposed in a bottom section of the casing 2 for retaining stacked sheets of a paper 3. A feeding roller 10 disposed above the front end of the paper tray 7 conveys the topmost sheet of paper 3 stacked in the paper tray 7 toward registration rollers 12. The registration rollers 12 function to correct skew in the sheet of paper 3 received from the feeding roller 10 and subsequently to convey the sheet of paper 3 onto a belt unit 35 in an image-forming unit 20.

The image-forming unit 20 includes the belt unit 35, a scanning unit 18, a process unit 70, and a fixing unit 42.

Figure 2:
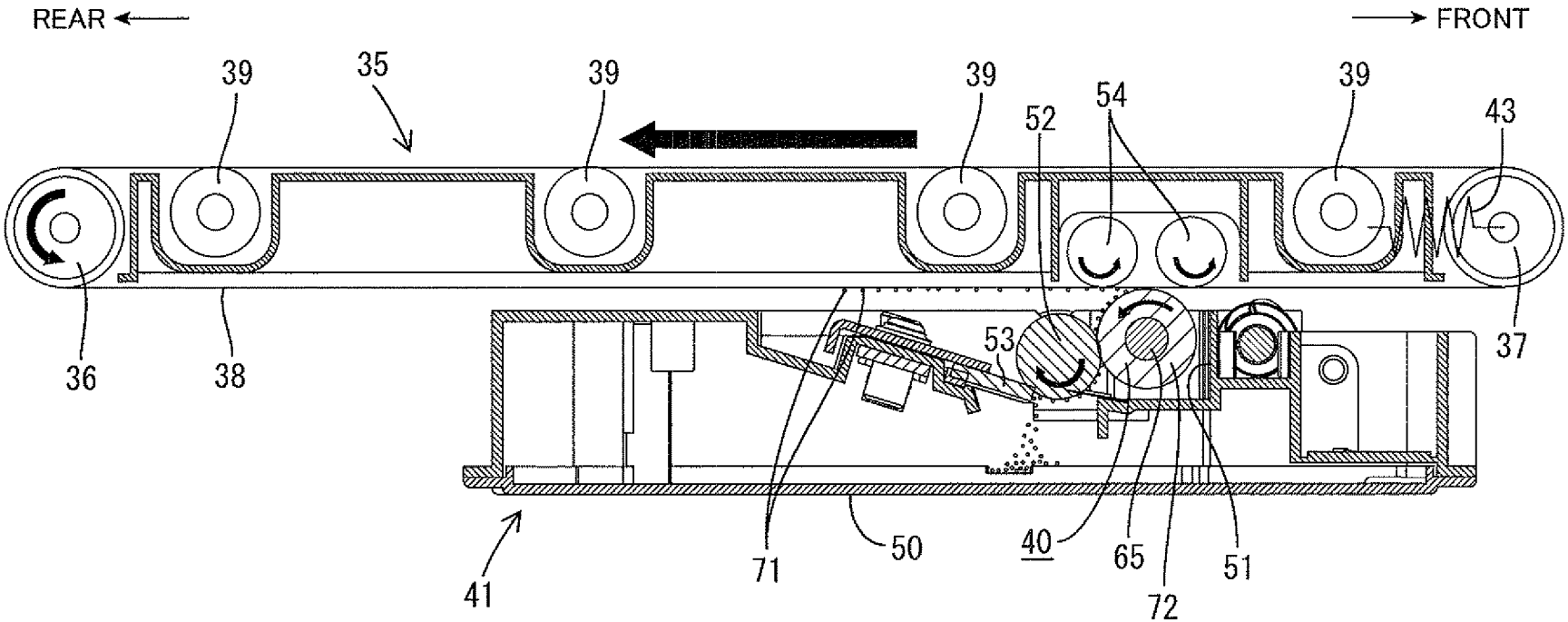
FIG. 2 is an enlarged cross-sectional view showing a belt unit and a cleaning unit according to the first embodiment.

The belt unit 35 is detachably mounted in the casing 2. As shown in FIG. 2, the belt unit 35 includes a pair of supporting rollers 36 and 37, and a belt 38 formed of polycarbonate or the like that is wound around the supporting rollers 36 and 37. By driving the supporting roller (driving roller) 36 disposed on the rear side to rotate, the belt 38 is moved circularly in the counterclockwise direction in FIG. 1, thereby conveying the sheet of paper 3 on the top surface of the belt 38 rearward.

A tension spring 43 is attached to the supporting roller (follower roller) 37 on the front side. The tension spring 43 (FIG. 2) urges the supporting roller 37 in a forward direction so that a fixed tension is applied to the belt 38 looped around the supporting rollers 36 and 37.

The scanning unit 18 includes laser light-emitting units (not shown) for emitting laser beams L that are irradiated onto the surfaces of corresponding photosensitive drums 30.

The process unit 70 includes a frame 21, and four developer cartridges 22 removably mounted in the frame 21 and corresponding to the four colors black, yellow, magenta, and cyan. The frame 21 can be pulled out through the front of the casing 2 after opening a front cover 6 disposed on the front surface of the casing 2. In the bottom of the frame 21, the photosensitive drums 30 and Scorotron chargers 31 corresponding to each of the developer cartridges 22 are provided. The surfaces of the photosensitive drums 30 are coated with a positive-charging photosensitive layer. Since the developer cartridges 22, photosensitive drums 30, and Scorotron chargers 31 have identical structures, only those parts on the left in FIG. 1 have been labeled.

Each developer cartridge 22 includes a toner-accommodating chamber 23 accommodating a toner of the corresponding color. A supply roller 25 disposed in the developer cartridge 22 supplies toner accommodated in the toner-accommodating chamber 23 to a developing roller 26. At this time, the toner is positively tribocharged between the supply roller 25 and developing roller 26.

As the photosensitive drum 30 rotates, the Scorotron charger 31 applies a uniform positive charge to the surface of the photosensitive drum 30. Subsequently, the charged surface of the photosensitive drum 30 is exposed to the laser beam L irradiated by the scanning unit 18, forming an electrostatic latent image on the surface of the photosensitive drum 30 corresponding to an image to be formed on the paper 3.

Next, the rotating developing roller 26 supplies toner onto the surface of the photosensitive drum 30. The toner is deposited only on areas of the surface that were exposed by the laser beam L, developing the electrostatic latent image into a visible toner image.

Transfer rollers 39 are disposed on the inside of the belt 38 at positions opposing the photosensitive drums 30, with the belt 38 interposed therebetween. As a sheet of paper 3 passes between the photosensitive drums 30 and corresponding transfer rollers 39, toner images carried on the surfaces of the photosensitive drums 30 are sequentially transferred onto the paper 3 as a result of a transfer bias voltage applied to the transfer rollers 39.

After toner images are transferred onto the paper 3, the belt 38 conveys the paper 3 to the fixing unit 42. In the fixing unit 42, the toner images are fixed to the paper 3 by heat. Subsequently, the paper 3 is discharged onto a discharge tray 47 provided on the top surface of the casing 2.

As shown in FIG. 2, a cleaning unit 41 is detachably mounted in the casing 2 beneath the belt unit 35. The cleaning unit 41 functions to remove extraneous matter 71 deposited on the outer surface of the belt 38. Examples of the extraneous matter 71 include toner printed on the belt 38 for calibrating density or registering color images, toner deposited on the belt 38 when a paper jam occurs, and paper dust produced from the paper 3.

The cleaning unit 41 includes a case 50 provided below the belt 38. The case 50 has a narrow shape elongated in the left-to-right (front-to-rear) direction. An opening 51 is formed in the top surface of the case 50 on the front side thereof. A cleaning roller 40 is rotatably provided inside the opening 51. The cleaning roller 40 is configured of a metal shaft 65 covered with a roller body 72 that is formed of a conductive foam material. The cleaning roller 40 is mounted such that the roller body 72 contacts the outer bottom surface of the belt 38.

A pair of metal backup rollers 54 is provided in the belt unit 35 at a position opposing the cleaning roller 40 via the belt 38. Since the cleaning unit 41 is detachably mounted in the casing 2, as described above, the cleaning roller 40 provided in the cleaning unit 41 and the backup rollers 54 provided in the belt unit 35 are relatively displaceable.

The cleaning roller 40 is driven by the force of a motor (not shown) provided in the casing 2 so that the outer surface of the cleaning roller 40 moves in a direction opposite the moving direction of the belt 38. By applying a prescribed bias between the cleaning roller 40 and backup rollers 54 at this time, the cleaning roller 40 can not only physically scrape the extraneous matter 71 from the outer surface of the belt 38, but can also electrically attract the extraneous matter 71. At this time, the backup rollers 54 rotate in the counterclockwise direction of FIG. 2, following the circular movement of the belt 38.

A metal recovery roller 52 is disposed diagonally below and rearward of the cleaning roller 40. The recovery roller 52 is capable of rotating while contacting the cleaning roller 40 with pressure. A predetermined bias is also applied between the recovery roller 52 and cleaning roller 40, causing the extraneous matter 71 deposited on the surface of the cleaning roller 40 to be electrically attracted to the surface of the recovery roller 52.

A rubber scraping blade 53 is provided for contacting the bottom surface of the recovery roller 52 with pressure. The extraneous matter 71 deposited on the surface of the recovery roller 52 is scraped off by the scraping blade 53 and collected in the case 50.

Figure 4:
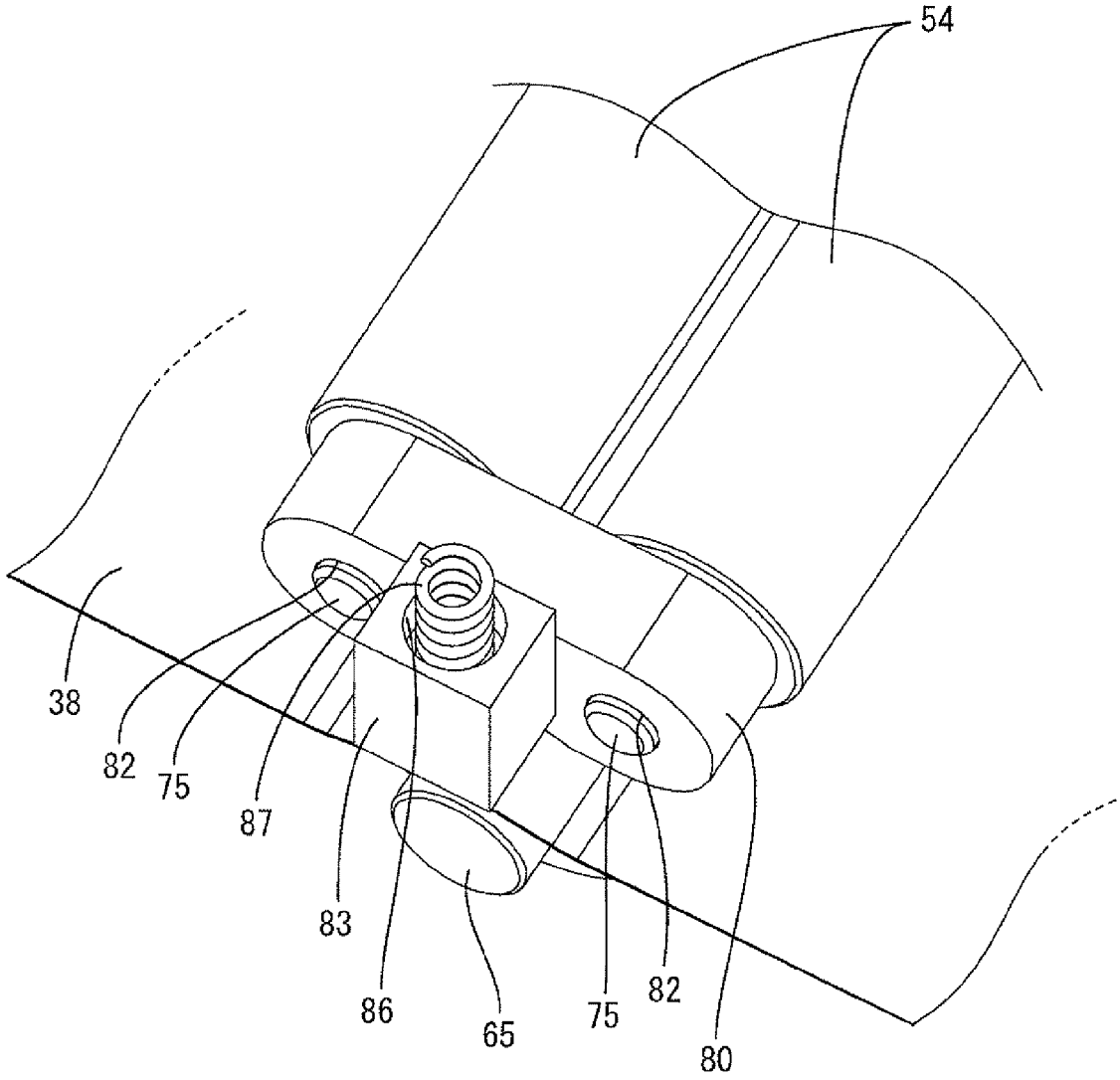
FIG. 4 is an enlarged perspective view showing a structure for mounting the backup rollers and a mounting member and a first spring according to the first embodiment.
Figure 5:
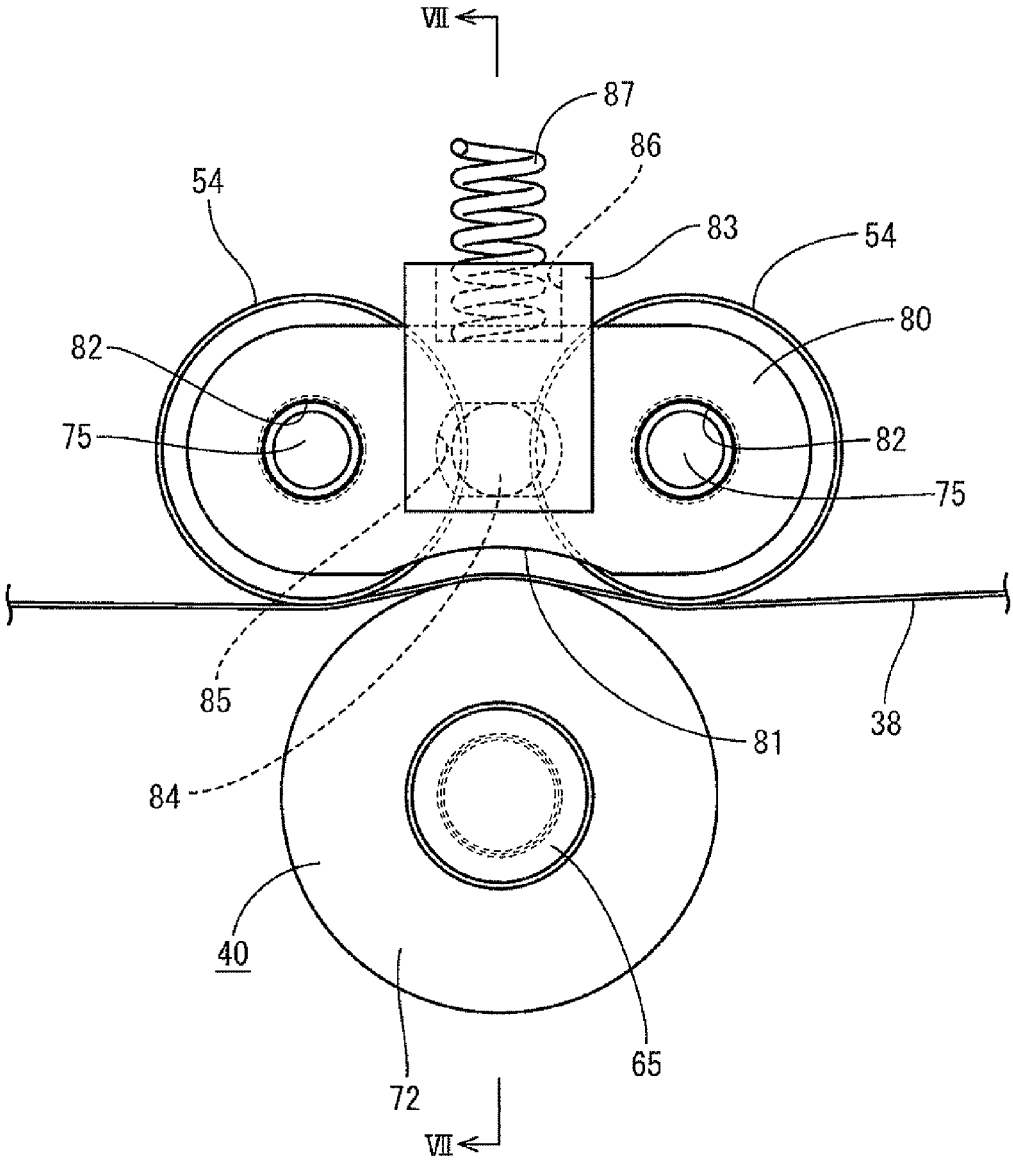
FIG. 5 is an enlarged side view showing the structure of the urging unit according to the first embodiment.
Figure 6:
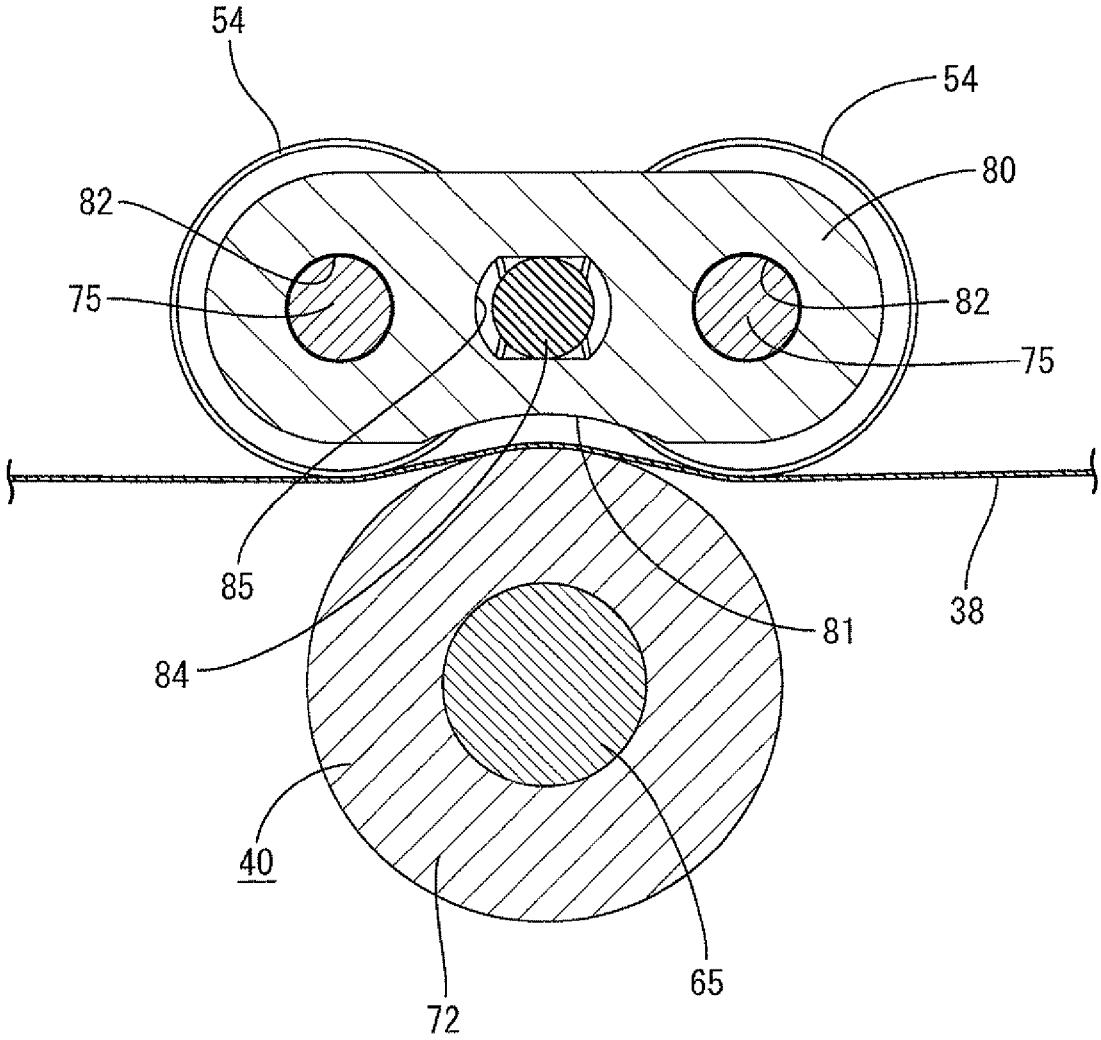
FIG. 6 is an enlarged cross-sectional view showing the structure of a pivoting unit according to the first embodiment.

As shown in FIGS. 4-6, each backup roller 54 is provided with a shaft 75 that protrudes out from both ends of the backup roller 54 in a direction following the rotational axis of the same.

Figure 3:
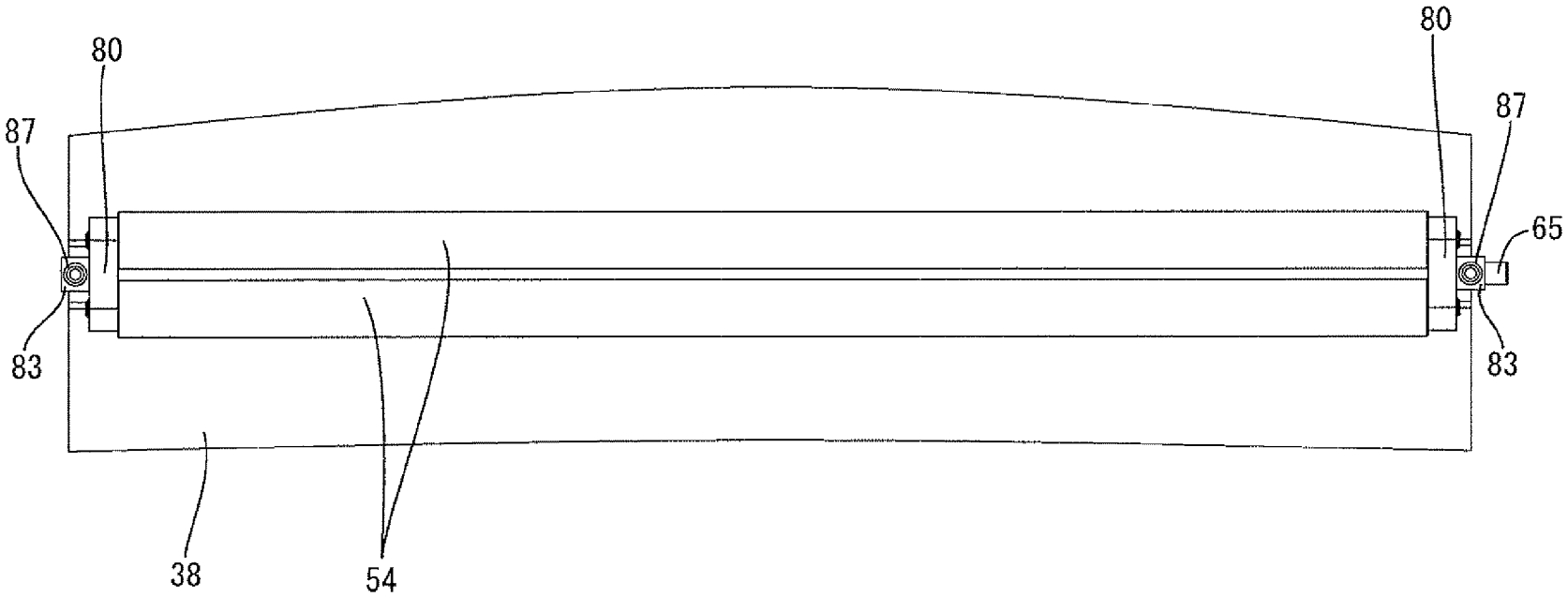
FIG. 3 is an enlarged plan view of backup rollers according to the first embodiment.

As shown in FIG. 3, coupling members 80 are provided for coupling like ends of the backup rollers 54 so that the rotational axes of the backup rollers 54 are maintained in a parallel state. The coupling members 80 are formed of a synthetic resin and are substantially elliptical in shape when viewed from the end, as shown in FIGS. 4-6. A depression 81 is formed in the bottom surface of the coupling member 80 in FIG. 5 so that the surface of the coupling member 80 recedes from the cleaning roller 40.

When the belt unit 35 and cleaning unit 41 are mounted in the casing 2 and held at their proper positions relative to the casing 2, the cleaning roller 40 is positioned between the pair of backup rollers 54, whose rotational axes are maintained in a parallel state.

Two through-holes 82 penetrate the coupling member 80 in left and right ends of FIG. 5 in a direction orthogonal to the surface of the drawing. The shafts 75 of the backup rollers 54 are rotatably inserted into the through-holes 82. The gap between the through-holes 82 is set greater than the outer diameter of the backup roller 54 so that the backup rollers 54 are separated from each other.

Mounting members 83 are mounted in the belt unit 35 outside of the coupling members 80 in FIG. 3 in the left-to-right direction (direction along the rotational axes of the backup rollers 54). The mounting members 83 can freely slide vertically through a guide mechanism (not shown). Each mounting member 83 is formed of a synthetic resin and has a substantially rectangular parallelepiped shape.

Figure 7A:
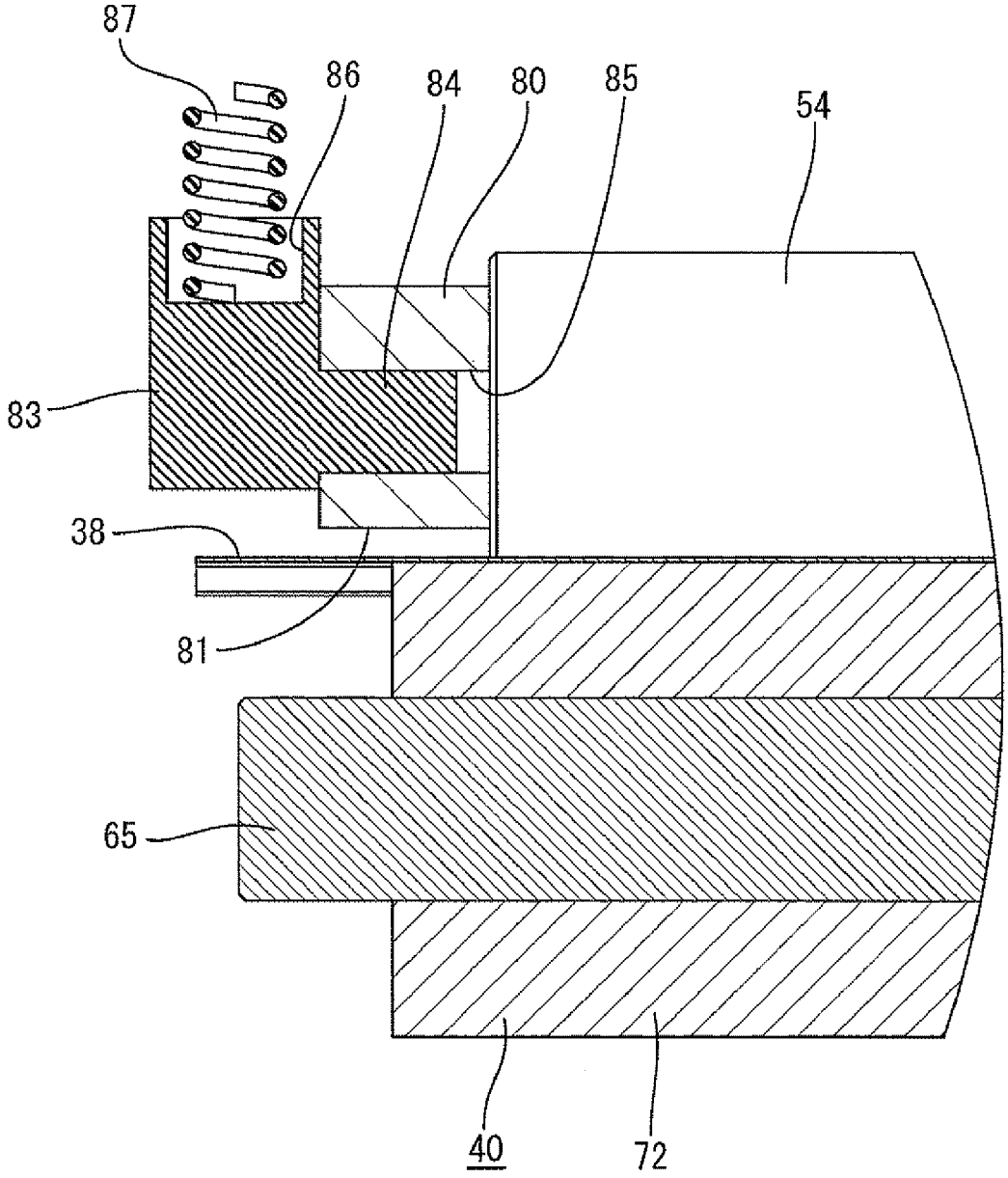
FIG. 7A is a cross-sectional view along the plane VII-VII in FIG. 5.

As shown in FIG. 7A, a pin 84 substantially columnar in shape is provided on the mounting member 83 so as to protrude toward the backup roller 54. A pinhole 85 in which the pin 84 can be inserted is formed in the coupling member 80 at a position corresponding to the pin 84 and penetrates the coupling member 80 in the left-to-right direction in FIG. 7 (along a rotational axis of the backup roller 54). The pin 84 and the pinhole 85 constitute a driving unit. As shown in FIG. 6, the pinhole 85 is elongated in the left-to-right direction (a direction orthogonal to the rotational axis of the backup roller 54) so that the coupling member 80 can pivot relative to the mounting member 83 in a direction orthogonal to the rotational axis of the backup roller 54.

As shown in FIG. 6, a space between inner top and bottom walls of the pinhole 85 is slightly larger than the outer diameter of the pin 84, and a space between inner left and right walls of the pinhole 85 is set sufficiently larger than the outer diameter of the pin 84.

As shown in FIG. 5, a recessed part 86 is formed in the upper surface of the mounting member 83. A first spring 87 is inserted into the recessed part 86. The mounting member 83 and the first spring 87 constitute an urging unit. The bottom end of the first spring 87 is attached to the inner bottom surface of the recessed part 86, and the top end, though not shown in the drawing, is fixed to the belt unit 35. The first spring 87 functions to urge the mounting member 83 downward in FIG. 5 (toward the cleaning roller 40). Accordingly, the mounting member 83 is mounted on the belt unit 35 so as to be capable of being displaced vertically in FIG. 7.

Next, the operations and effects of this embodiment will be described. As an example, when replacing the cleaning unit 41, the operator opens the front cover 6, removes the belt unit 35, and subsequently removes the cleaning unit 41.

The method of installing a new cleaning unit 41 is as follows. After mounting the cleaning unit 41 in the casing 2, the belt unit 35 is similarly mounted in the casing 2. At this time, the belt 38 contacts the top of the cleaning roller 40 with pressure.

The pair of backup rollers 54, disposed on the opposite side of the belt 38 and in opposition to the cleaning roller 40, apply pressure to the top of the cleaning roller 40 through the belt 38. The backup rollers 54 are held in the mounting members 83 through the coupling members 80, and the mounting members 83 are attached to the belt unit 35 in a manner that allows vertical movement while being urged toward the cleaning roller 40 by the first springs 87. Accordingly, the backup rollers 54 are also urged toward the cleaning roller 40, pressing against the belt 38 so that the belt 38 also reliably contacts the cleaning roller 40 with pressure.

By applying the prescribed bias between the cleaning roller 40 and backup rollers 54, the extraneous matter 71 deposited on the belt 38 is electrically attracted to the cleaning roller 40 while the cleaning roller 40 also physically scrapes the extraneous matter 71 off the belt 38. A predetermined bias is also applied between the recovery roller 52 and cleaning roller 40, attracting the extraneous matter 71 transferred onto the surface of the cleaning roller 40 to the recovery roller 52, while the recovery roller 52 also physically scrapes the extraneous matter 71 off the surface of the cleaning roller 40.

Additionally, the rubber scraping blade 53 contacts the bottom of the recovery roller 52 with pressure, scraping the extraneous matter 71 off the surface of the recovery roller 52 so that the extraneous matter 71 accumulates in the case 50.

When the belt unit 35 and cleaning unit 41 are mounted in the casing 2 and held at their proper positions relative to the casing 2, the cleaning roller 40 is positioned between the pair of backup rollers 54, which are maintained in the coupling members 80 so that their rotational axes are parallel. Accordingly, the area of contact between the cleaning roller 40 and belt 38 can be increased in the region of the belt 38 pressed against the cleaning roller 40 by the backup rollers 54, as shown in FIGS. 5 and 6. This configuration enables the cleaning roller 40 to more effectively remove the extraneous matter 71 from the outer surface of the belt 38.

However, if one of the belt unit 35 and cleaning unit 41 deviates from its proper position relative to the casing 2 when mounted therein, the cleaning roller 40 may be held such that its rotational axis intersects with the rotational axes of the backup rollers 54, for example. As in the above example, the cleaning roller 40 presses against the bottom of the backup rollers 54 through the belt 38 in this case.

At this time, the backup rollers 54, which are pivotably supported in a direction orthogonal to the rotational axes of the backup rollers 54, pivot along the surface of the cleaning roller 40 through the engagement of the pins 84 on the mounting member 83 in the pinholes 85 formed in the coupling members 80. Accordingly, the backup rollers 54 are displaced so that the cleaning roller 40 is positioned between the parallel backup rollers 54 and the rotational axes of the backup rollers 54 are parallel to the rotational axis of the cleaning roller 40. Consequently, the cleaning roller 40 and the backup rollers 54 are maintained in correct positions relative to each other at all times, regardless of whether the belt unit 35 and cleaning unit 41 are mounted in the proper position relative to the casing 2. In other words, by relatively displacing the coupling members 80 and mounting members 83 engaged through the pins 84 and pinholes 85, it is possible to absorb positional deviation between the backup rollers 54 and the cleaning roller 40.

Hence, this embodiment ensures that the cleaning roller 40 contacts the belt 38 with sufficient pressure across the entire length in the width direction (left-to-right direction), even when the cleaning unit 41 mounted in the casing 2 deviates from its proper position. Accordingly, this embodiment improves the efficiency of the cleaning unit 41 for removing extraneous matter 71 from the belt 38.

Further, in this embodiment, the coupling members 80 hold the backup rollers 54 so that a gap is maintained therebetween. This configuration stabilizes the positional relationship of the backup rollers 54 so that the backup rollers 54 can apply a stable force to the cleaning roller 40.

With this embodiment described above, the pins 84 inserted into the pinholes 85 can be displaced in a direction orthogonal to the rotational axes of the backup rollers 54. Hence, through the simple construction of the pins 84 and pinholes 85, the preferred embodiment can pivotably support the backup rollers 54.

Further, this embodiment described above implements urging unit for urging the backup rollers 54 against the cleaning roller 40 through the simple construction of the mounting members 83 and the first springs 87.

According to this embodiment described above, the belt unit 35 is detachably mounted in the casing 2, and the cleaning unit 41 is also detachably mounted in the casing 2. Accordingly, both the belt 38 and the cleaning roller 40 can easily be replaced.

Second Embodiment

Next, a second embodiment of the present invention will be described with reference to FIGS. 8-11. Components in the second embodiment having the same structure as those in the first embodiment have been designated with the same reference numerals to avoid duplicating description. In the second embodiment, metal levers 92 each have a mounting member 90. The levers 92 are mounted in the belt unit 35 on the outside of the coupling members 80 in the left-to-right direction of FIG. 8 (along the rotational axes of the backup rollers 54). As shown in FIG. 11, the mounting members 90 are stepped pins formed of metal and are fitted into and fixed in distal ends of the metal levers 92.

Figure 10:
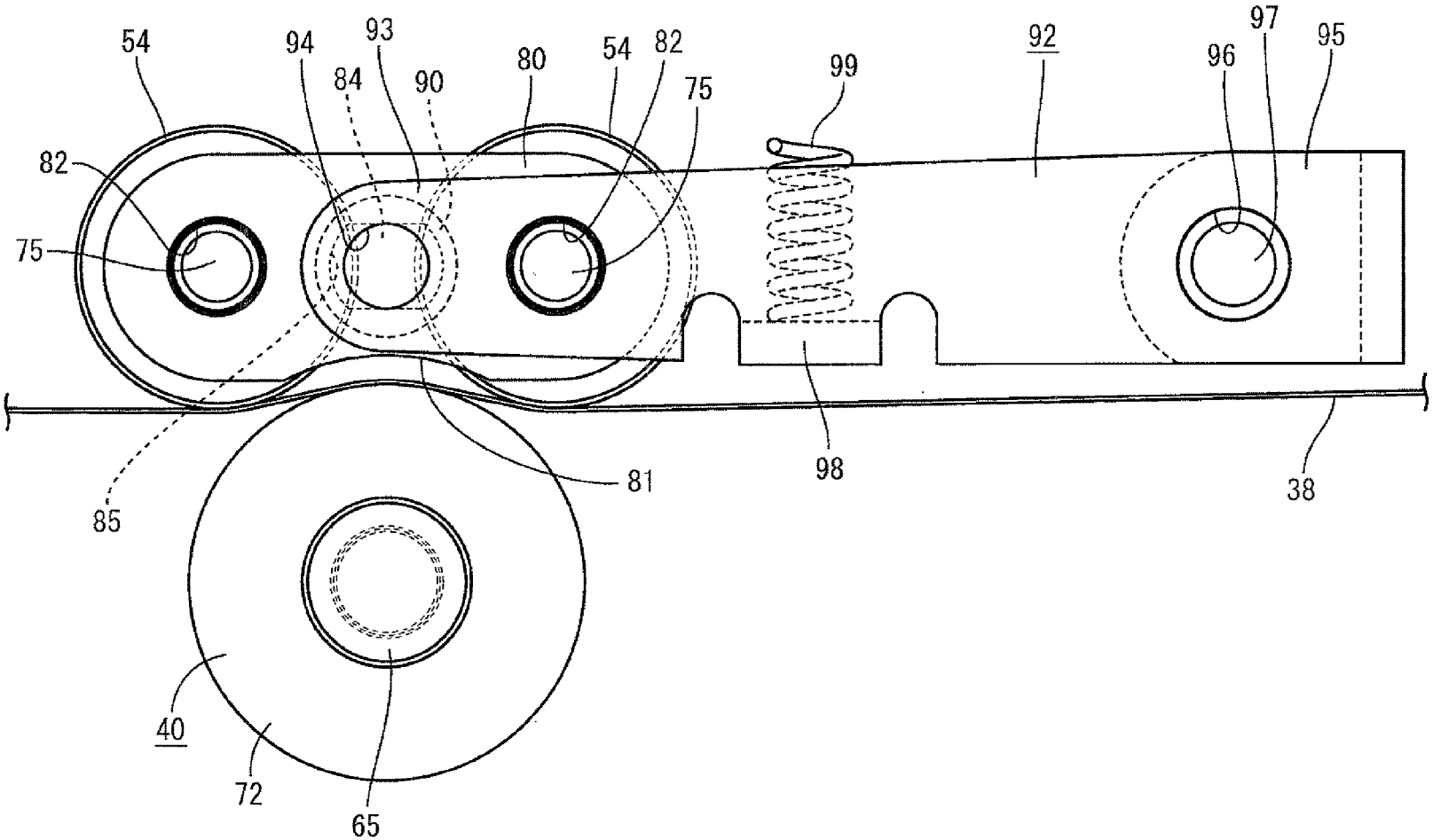
FIG. 10 is an enlarged side view showing the structure of the lever, the second spring, the pin, and pinhole.
Figure 11:
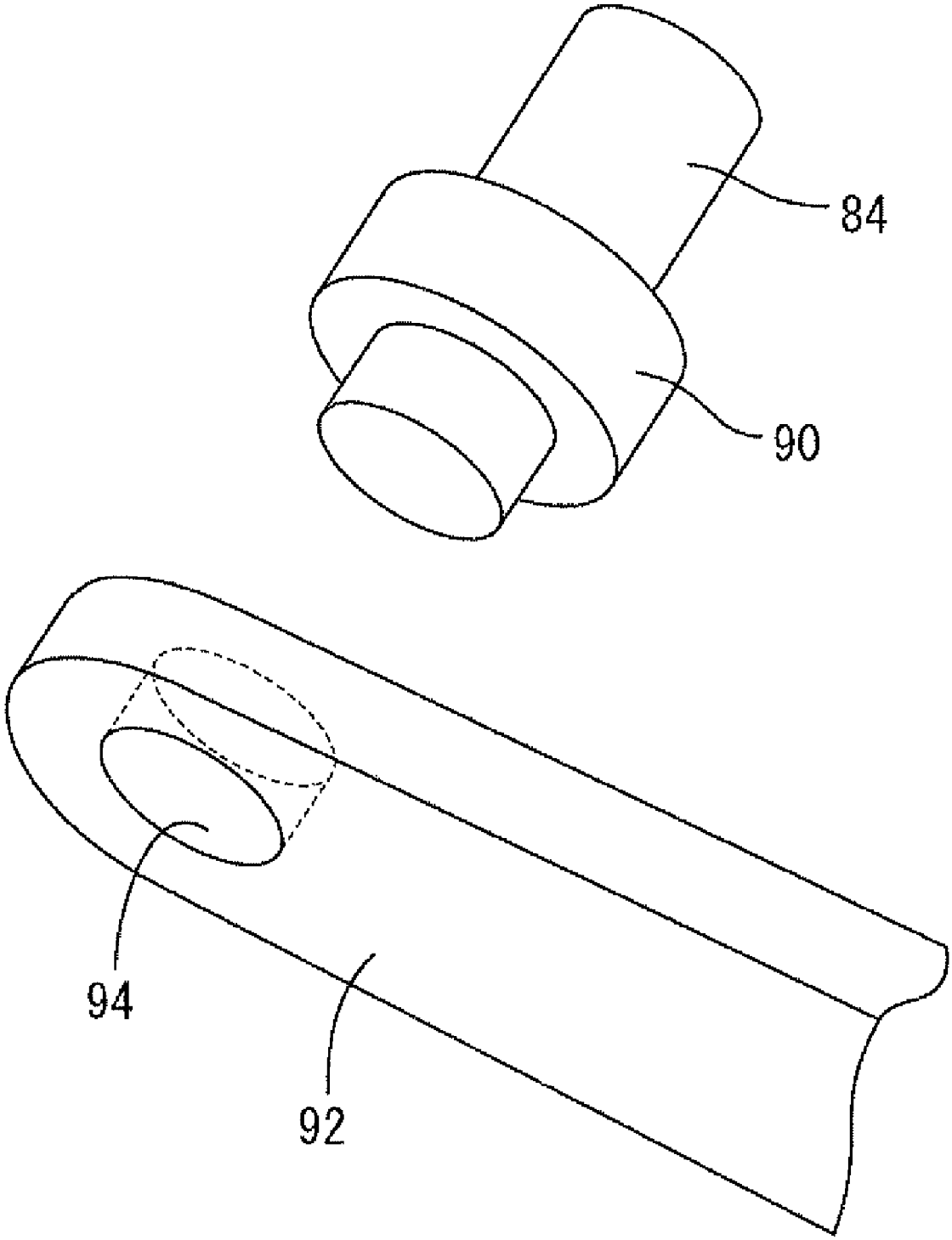
FIG. 11 is a perspective view showing a mounting member and a lever according to the second embodiment.

As shown in FIG. 10, the substantially columnar pins 84 protrude from the mounting members 90 toward the backup rollers 54. The pinholes 85 in which the pins 84 can be inserted are formed in the coupling members 80 at positions corresponding to the pins 84 and penetrate the coupling members 80 in a direction orthogonal to the surface of the drawing in FIG. 10 (direction along the rotational axes of the backup rollers 54). The pinholes 85 are elongated in the left-to-right direction in FIG. 10 (directional orthogonal to the rotational axes of the backup rollers 54).

Figure 8:
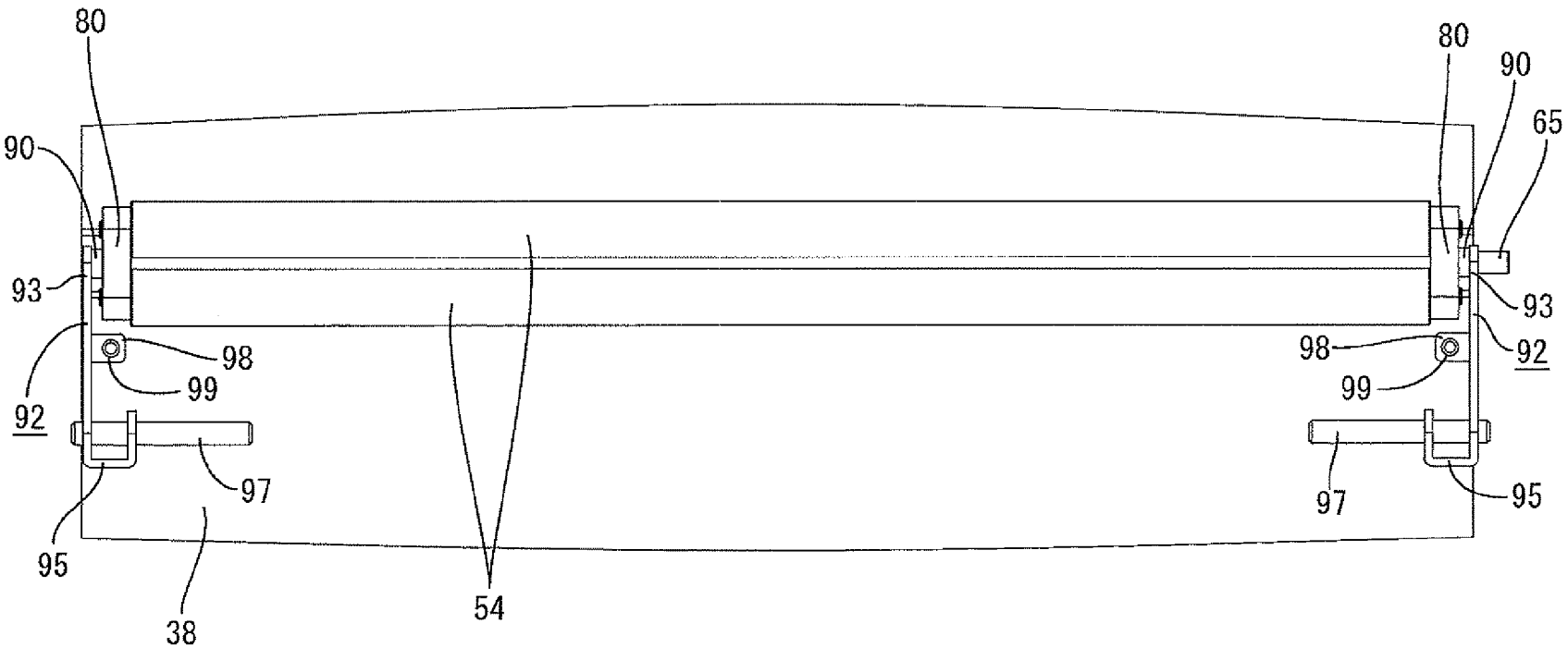
FIG. 8 is an enlarged plan view showing a backup roller according to a second embodiment of the present invention.

As shown in FIG. 8, each of the levers 92 has a narrow elongated plate-shape. A through-hole 94 is formed in the top end of each lever 92 in FIG. 8 (hereinafter referred to as a "connecting end 93") and penetrates the thickness of the lever 92. An end of the mounting member 90 is fitted into and fixed in the through-hole 94.

Figure 9:
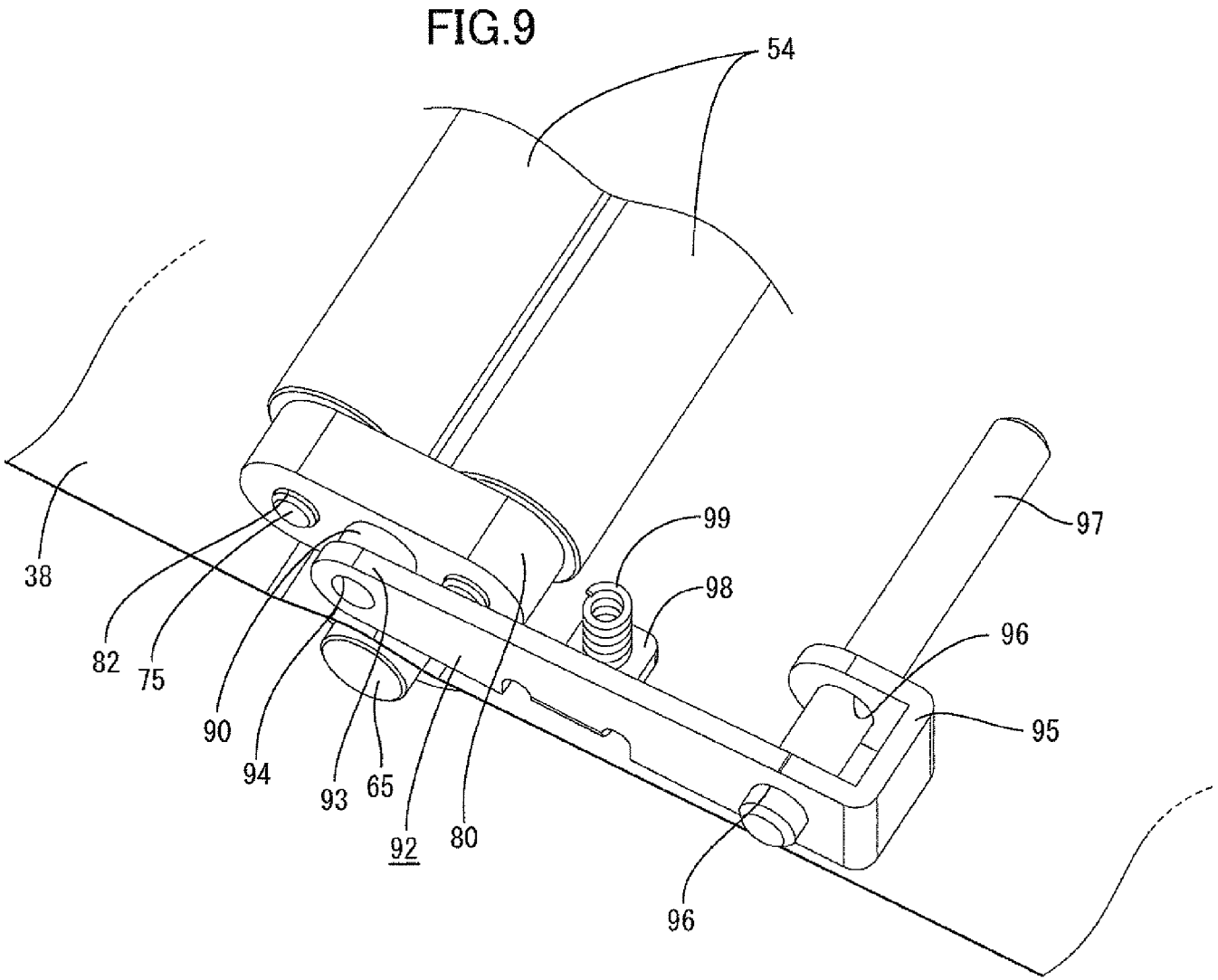
FIG. 9 is an enlarged perspective view showing the structure for mounting the backup rollers, a lever and a second spring.

A substantially U-shaped angled part 95 is formed on the bottom end of each lever 92 in FIG. 8 by twice bending the end at right angles in the same direction. As shown in FIG. 9, through-holes 96 are formed through two opposing sides of the angled part 95, penetrating the sides in the thickness direction of the lever 92. One end of a metal rotational shaft 97 is inserted through the through-holes 96, enabling the lever 92 to pivot about the rotational shaft 97. While not shown in detail in the drawing, the rotational shaft 97 is rotatably supported in the belt unit 35.

A base part 98 is formed on the bottom edge of the lever 92 near the left-and-right center thereof in FIG. 10. The base part 98 can be disposed at an arbitrary position that is different from the connecting end 93. As shown in FIG. 9, the base part 98 is formed by bending the metal plate constituting the lever 92 to a direction along the rotational axes of the backup rollers 54. The bottom end of a second spring 99 is attached to the top surface of the base part 98, while the top end of the second spring 99 is fixed to the belt unit 35 (not shown in the drawing). The second spring 99 urges the mounting member 90 downward in FIG. 10 (toward the cleaning roller 40) through the lever 92.

With the second embodiment described above, the second springs 99 urge the base parts 98 toward the cleaning roller 40, causing the levers 92 to rotate about the rotational shafts 97 toward the cleaning roller 40. Accordingly, the mounting members 90 and coupling members 80 attached to the connecting ends 93 of the levers 92 also rotate, and the backup rollers 54 held in the coupling members 80 are thus urged toward the cleaning roller 40 (downward in FIG. 10).

In the second embodiment described above, the second springs 99 are attached to the levers 92 near the left-and-right centers thereof in FIG. 10 at positions different from the connecting ends 93. Accordingly, the stroke of the second springs 99 is less than that required for rotating the connecting ends 93 of the levers 92. As a result, it is possible to reduce the overall size of the levers 92 and second springs 99 in the direction that the levers 92 rotate by this amount of stroke reduction.

Third Embodiment

Figure 13:
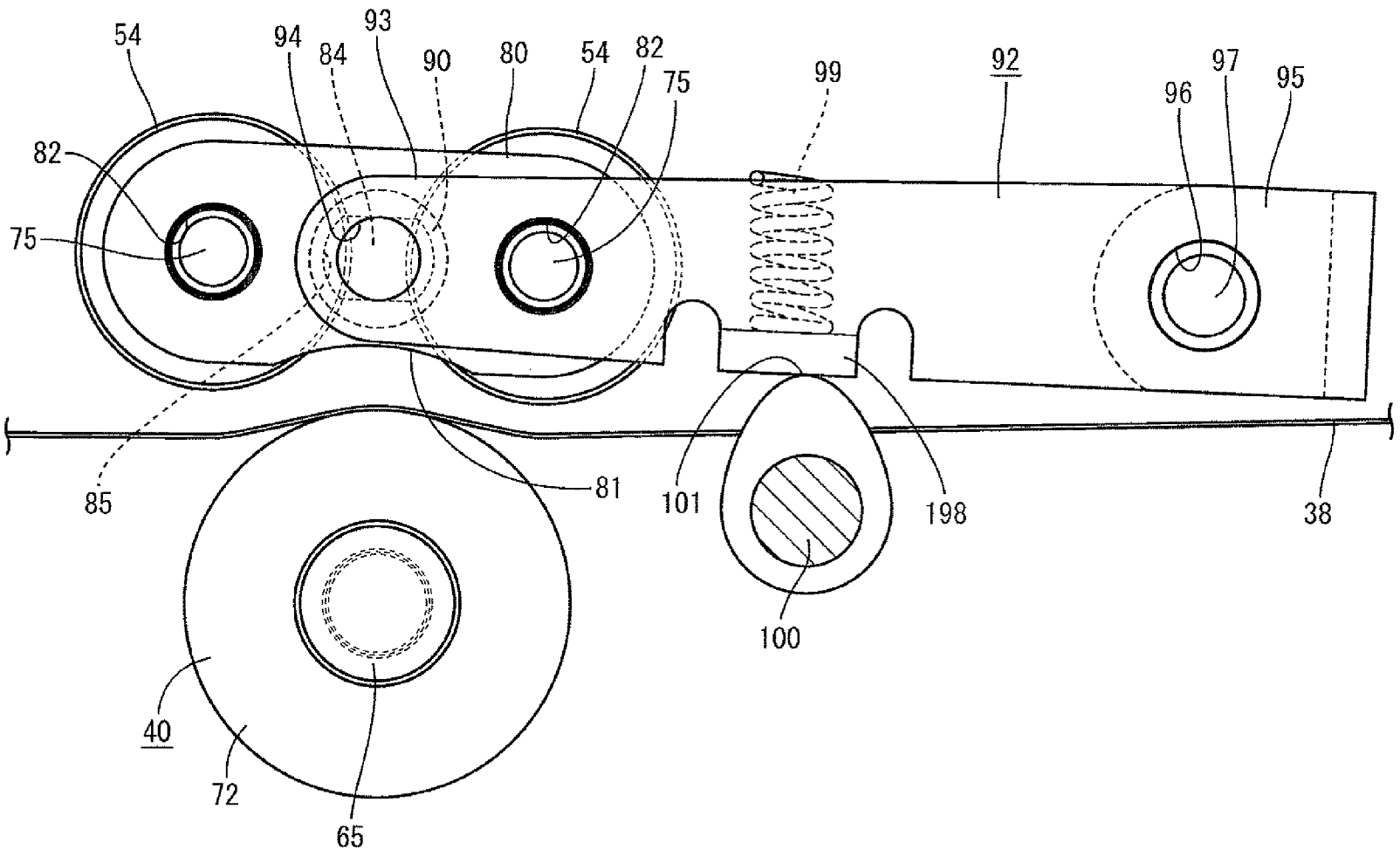
FIG. 13 is an enlarged side view showing the state of the cam according to the third embodiment during an image-forming operation.
Figure 14:
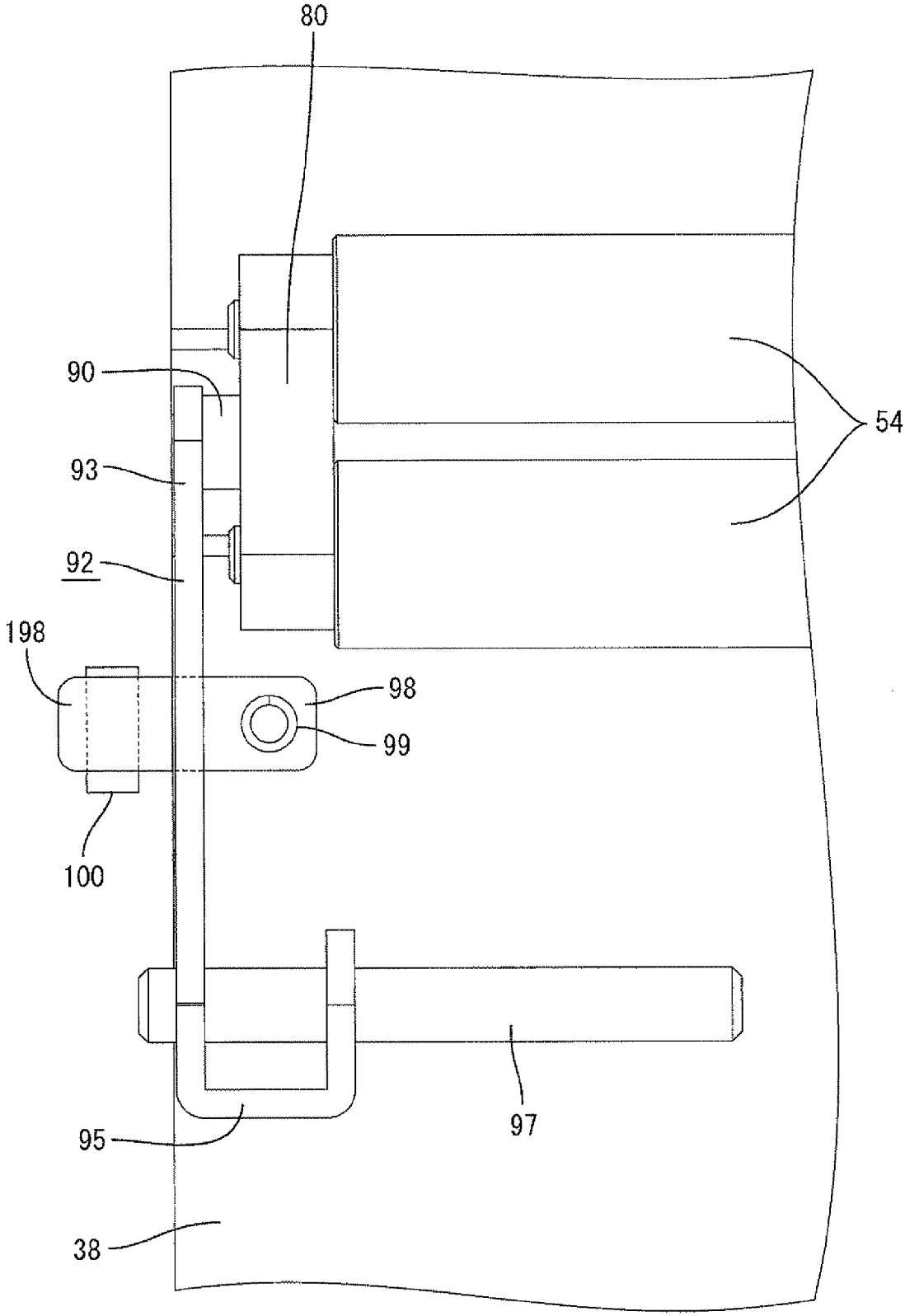
FIG. 14 is an enlarged plan view showing a second base unit according to the third embodiment.

Next, a third embodiment of the present invention will be described with reference to FIGS. 12-14. As shown in FIG. 14, in the third embodiment, a second base part 198 protrudes farther outward than the belt 38 from the base part 98 of the lever 92. A cam 100 is disposed below the second base part 198 and contacts the second base part 198 from the bottom thereof. As shown in FIG. 13, the cam 100 has a nose part 101. When the nose part 101 of the cam 100 contacts the second base part 198, the lever 92 is pushed upward. In this state, the backup rollers 54 are separated from the belt 38 and, hence, do not apply pressure to the belt 38.

Figure 12:
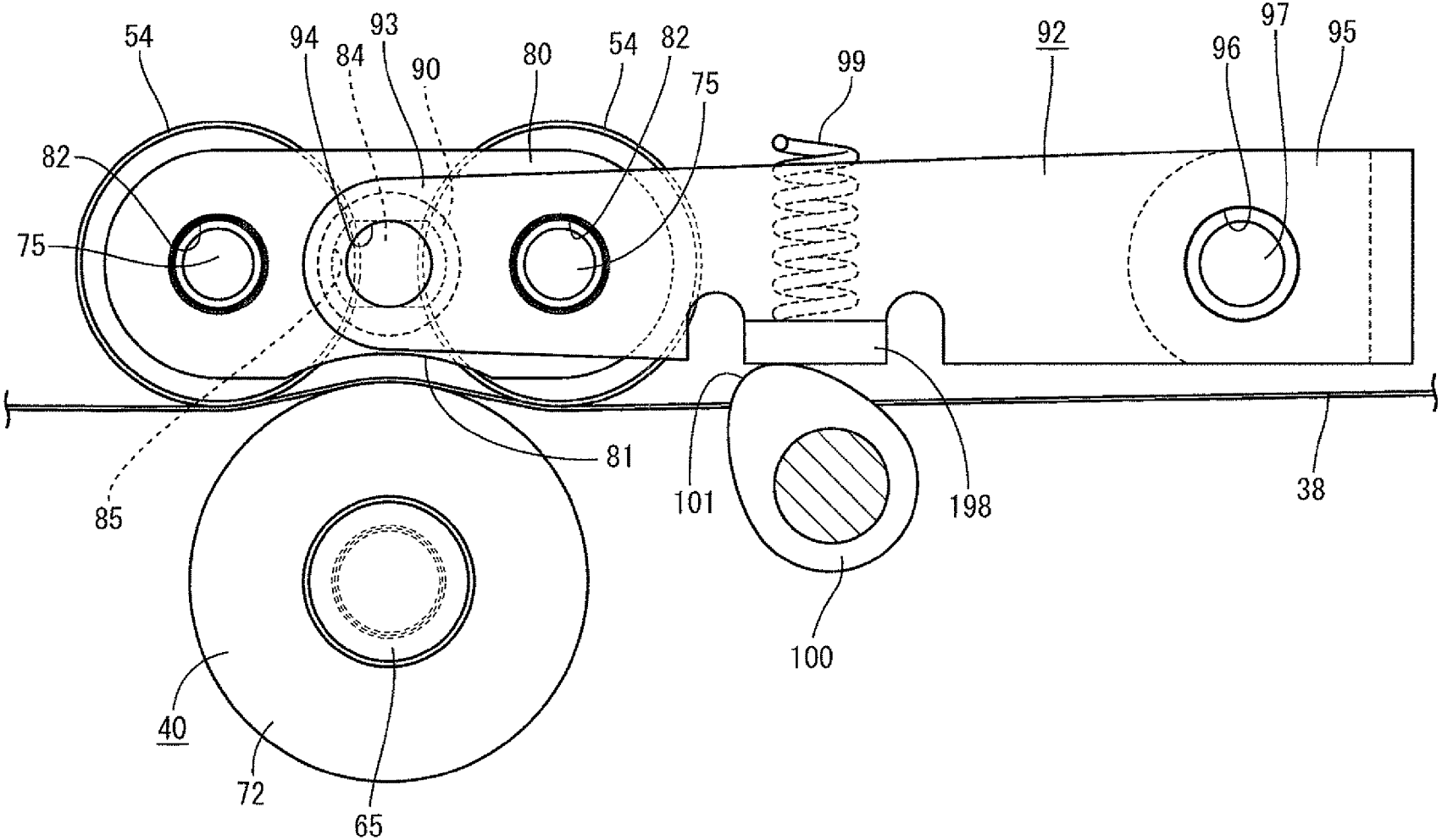
FIG. 12 is an enlarged side view showing the state of a cam according to a third embodiment during a cleaning operation.

However, when a surface of the cam 100 different from the nose part 101 contacts the second base part 198, as shown in FIG. 12, the cam 100 no longer applies a force for pushing the lever 92 upward. Consequently, the backup rollers 54 apply a force to the belt 38.

Since the remaining structure in the third embodiment is identical to that in the second embodiment, like parts and components are designated with the same reference numerals to avoid duplicating description.

During a cleaning operation with the device according to the third embodiment, a surface of the cam 100 different from the nose part 101 is placed in contact with the second base part 198, as shown in FIG. 12, so that the belt 38 is pinched between the backup rollers 54 and the cleaning roller 40. Consequently, the cleaning roller 40 can reliably remove the extraneous matter 71 deposited on the belt 38.

On the other hand, during image-forming operations, including transferring and fixing images on the paper 3, the nose part 101 of the cam 100 is placed in contact with the second base part 198, as shown in FIG. 13, separating the backup rollers 54 from the belt 38. This configuration reduces the load placed on the belt 38 during image-forming operations, enabling the belt 38 to convey the paper 3 with stability.

Further, since the cleaning roller 40 only receives pressure from the backup rollers 54 during a cleaning operation, the structure of the third embodiment can reduce degradation of the cleaning roller 40 caused by sliding against the belt 38.

Variations of the Embodiments

While the invention has been described in detail with reference to specific embodiments thereof, it would be apparent to those skilled in the art that many modifications and variations may be made therein without departing from the spirit of the invention, the scope of which is defined by the attached claims.

(1) In those embodiments described above, the pivoting unit is configured of the pins 84 and pinholes 85, but is not limited to this construction. For example, the backup rollers 54 can be held through a ball joint construction including engaging parts having spherical surfaces and engaging part receiving parts provided with walls capable of gripping these spherical surfaces, thereby enabling the backup rollers 54 to pivot relative to the cleaning roller 40.

(2) In those embodiments described above, the cleaning unit 41 is detachably mounted in the casing 2 but is not limited to this construction. For example, the cleaning unit 41 may have any arbitrary construction, provided that the cleaning unit 41 can be pulled from the casing 2 at least to a position for replacing the cleaning roller 40 and that the cleaning roller 40 and the backup rollers 54 can be relatively displaced.

Figure 7B:
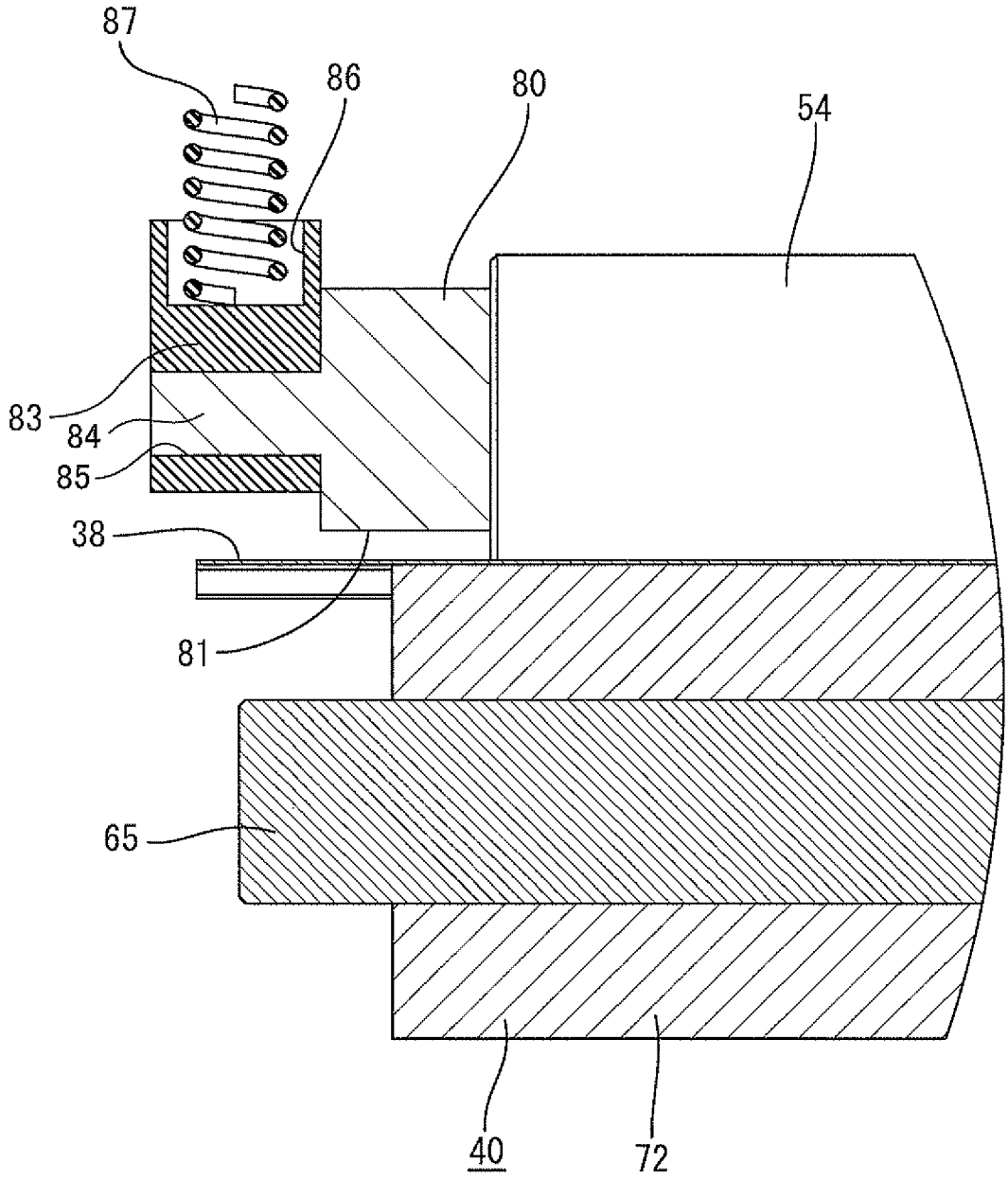
FIG. 7B is a cross-sectional view along the plane VII-VII in FIG. 5 according to a modification to the cross-sectional view of FIG. 7A.

(3) In those embodiments described above, the pins 84 are provided on the mounting members 83 or the mounting members 90, and the pinholes 85 are provided on the coupling members 80, but it is also possible to provide the pins 84 on the coupling members 80 and the pinholes 85 on the mounting members 83 or mounting members 90 as shown in FIG. 7B.

(4) Those embodiments described above, the first springs 87 and second springs 99 are configured of coil springs, but these components may be configured of any type of spring capable of urging the backup rollers 54 toward the cleaning roller 40, such as volute springs or leaf springs.

(5) In those embodiments described above, the backup rollers 54 are held in coupling members 80 so that a gap is maintained between the backup rollers 54. However, a link mechanism well known in the art may be used to hold the backup rollers 54 so that their rotational axes are parallel while allowing the gap between the backup rollers 54 to be adjusted.

(6) In those embodiments described above, both the belt unit 35 and the cleaning unit 41 are detachably mounted in the casing 2, but it is possible to configure the printer 1 so that only one of the belt unit 35 and cleaning unit 41 is detachably mounted in the casing 2. Alternatively, both the belt unit 35 and the cleaning unit 41 may be fixed in the casing 2. In the latter case, the pivoting unit of the present invention would have the effect of absorbing manufacturing errors during assembly.

What is claimed is:

1. An image-forming device comprising:

a main body that includes an image-forming unit for forming images on a recording medium;

a belt that is disposed in the main body and moves circularly, the belt having an outer surface;

a cleaning roller that contacts the outer surface of the belt for removing extraneous matter deposited on the outer surface of the belt;

a pair of backup rollers that is disposed in opposition to the cleaning roller with the belt interposed between the backup rollers and the cleaning roller, each of the backup rollers having a rotational axis, the pair of backup rollers contacting the belt at first and second positions and the cleaning roller contacting the belt at a third position where the third position is interposed between the first and second positions;

a holder that rotatably holds the pair of backup rollers, rotational axes of the backup rollers being kept parallel to each other;

an urging unit for urging the backup rollers toward the cleaning roller; and a driving unit that is supported on the main body and that moves the holder to change a distance between the pair of backup rollers and the cleaning roller, wherein the driving unit comprises:

an engaging member that is provided on the holder; and a receiving member that is provided on the urging unit and pivotably engages with the engaging member.

2. The image-forming device according to claim 1, wherein the engaging member is a pin protruding from the holder in a first direction parallel to the rotational axes; and wherein the receiving member is a pinhole penetrating the urging unit in the first direction and is formed in a shape elongated in a second direction different from the first direction.

3. The image-forming device according to claim 2, wherein a gap is formed between the pin and the urging unit formed with the pinhole in the second direction.

4. The image-forming device according to claim 1, further comprising a cleaning unit that includes the cleaning roller and that is detachably mounted in the main body.

5. The image-forming device according to claim 1, wherein the urging unit comprises:

a mounting member that is connected to the holder; and a spring that is attached to the mounting member and urges the mounting member toward the cleaning roller.

6. The image-forming device according to claim 1, wherein each of the backup rollers has one end and another end; and wherein the holder includes a first coupling member that couples the one ends of the pair of backup rollers and a second coupling member that couples the another ends of the pair of backup rollers, the first coupling member and the second coupling member keep a distance between the pair of backup rollers.

7. The image-forming device according to claim 1, wherein the belt transports the recording medium placed thereon.

8. An image-forming device comprising:

a main body that includes an image-forming unit for forming images on a recording medium;

a belt that is disposed in the main body and moves circularly, the belt having an outer surface;

a cleaning roller that contacts the outer surface of the belt for removing extraneous matter deposited on the outer surface of the belt;

a pair of backup rollers that is disposed in opposition to the cleaning roller with the belt interposed between the backup rollers and the cleaning roller, each of the backup rollers having a rotational axis, the pair of backup rollers contacting the belt at first and second positions and the cleaning roller contacting the belt at a third position where the third position is interposed between the first and second positions;

a holder that rotatably holds the pair of backup rollers, rotational axes of the backup rollers being kept parallel to each other;

an urging unit for urging the backup rollers toward the cleaning roller; and a driving unit that is supported on the main body and that moves the holder to change a distance between the pair of backup rollers and the cleaning roller, wherein the driving unit comprises:

an engaging member that is provided on the urging unit; and a receiving member that is provided on the holder and pivotably engages with the engaging member.

9. The image-forming device according to claim 8, wherein the engaging member is a pin protruding from the urging unit in a first direction parallel to the rotational axes; and wherein the receiving member is a pinhole penetrating the holder in the first direction and is formed in a shape elongated in a second direction different from the first direction.

10. The image-forming device according to claim 9, wherein a gap is formed between the pin and the holder formed with the pinhole in the second direction.

11. The image-forming device according to claim 8, further comprising a cleaning unit that includes the cleaning roller and that is detachably mounted in the main body.

12. The image-forming device according to claim 8, wherein the urging unit comprises:

a mounting member that is connected to the holder; and a spring that is attached to the mounting member and urges the mounting member toward the cleaning roller.

13. The image-forming device according to claim 8, wherein each of the backup rollers has one end and another end; and wherein the holder includes a first coupling member that couples the one ends of the pair of backup rollers and a second coupling member that couples the another ends of the pair of backup rollers, the first coupling member and the second coupling member keep a distance between the pair of backup rollers.

14. The image-forming device according to claim 8, wherein the belt transports the recording medium placed thereon.

15. An image-forming device comprising:

a main body that includes an image-forming unit for forming images on a recording medium;

a belt that is disposed in the main body and moves circularly, the belt having an outer surface;

a cleaning roller that contacts the outer surface of the belt for removing extraneous matter deposited on the outer surface of the belt;

a pair of backup rollers that is disposed in opposition to the cleaning roller with the belt interposed between the backup rollers and the cleaning roller, each of the backup rollers having a rotational axis, the pair of backup rollers contacting the belt at first and second positions and the cleaning roller contacting the belt at a third position where the third position is interposed between the first and second positions;

a holder that rotatably holds the pair of backup rollers, rotational axes of the backup rollers being kept parallel to each other;

an urging unit for urging the backup rollers toward the cleaning roller; and a driving unit that is supported on the main body and that moves the holder to change a distance between the pair of backup rollers and the cleaning roller, wherein the urging unit further comprises:

a lever that has one end attached to the holder and another end, the lever being pivotably supported on the main body to pivot about the another end; and a spring that is attached to the holder at a position different from the one end of the lever and urges the one end of the lever toward the cleaning roller.

16. The image-forming device according to claim 15, further comprising a cam that contacts the lever, and wherein when the cam is in a first rotational position, the cam applies a force to the lever for pivoting the lever to separate the pair of backup rollers from the belt, and when the cam is in a second rotational position, the cam contacts the lever without applying a force to make the pair of backup rollers contacts the belt.

17. The image-forming device according to claim 15, further comprising a cleaning unit that includes the cleaning roller and that is detachably mounted in the main body.

18. The image-forming device according to claim 15, wherein each of the backup rollers has one end and another end; and wherein the holder includes a first coupling member that couples the one ends of the pair of backup rollers and a second coupling member that couples the another ends of the pair of backup rollers, the first coupling member and the second coupling member keep a distance between the pair of backup rollers.

19. The image-forming device according to claim 15, wherein the belt transports the recording medium placed thereon.

* * * * *